US008613286B2

(12) United States Patent
Kennedy et al.

(10) Patent No.: US 8,613,286 B2
(45) Date of Patent: Dec. 24, 2013

(54) METHOD AND DEVICE FOR DISPENSING A MATERIAL INTO A REPRESENTATION ON A SURFACE

(76) Inventors: Melvin R. Kennedy, Santa Barbara, CA (US); Jose Longoria, Miami, FL (US); Susan M. Matsumoto, Santa Barbara, CA (US)

( * ) Notice: Subject to any disclaimer, the term of this patent is extended or adjusted under 35 U.S.C. 154(b) by 0 days.

(21) Appl. No.: 13/606,217

(22) Filed: Sep. 7, 2012

(65) Prior Publication Data

US 2013/0068119 A1 Mar. 21, 2013

Related U.S. Application Data

(60) Provisional application No. 61/627,111, filed on Sep. 19, 2011.

(51) Int. Cl.
*A45D 40/26* (2006.01)

(52) U.S. Cl.
USPC ..... 132/320

(58) Field of Classification Search
USPC ..... 132/74.5, 317–320; 401/183–186, 196, 401/198, 202–207, 261, 263–267, 270–276, 401/282, 283; 222/207, 212–215, 387, 494
See application file for complete search history.

(56) References Cited

U.S. PATENT DOCUMENTS 1,959,774 A 5/1934 Walsh
2,259,992 A * 10/1941 Binon ..... 222/179.5
2,939,615 A * 6/1960 Lerner ..... 222/207
3,148,401 A 9/1964 Gilchrist et al.
3,410,645 A 11/1968 Schwartzman
3,418,055 A 12/1968 Schwartzman
3,433,232 A 3/1969 Garrett
3,545,874 A * 12/1970 Schwartzman ..... 401/186
3,570,396 A * 3/1971 Schwartzman ..... 101/125
3,726,289 A 4/1973 Thompson
4,201,491 A 5/1980 Kohler
5,019,033 A 5/1991 Geria
5,222,823 A 6/1993 Conforti
5,421,765 A 6/1995 Lehmann et al.
5,727,893 A 3/1998 Handler
5,799,669 A 9/1998 Briggs
5,823,204 A 10/1998 Todd
5,848,599 A 12/1998 Todd (Continued)

FOREIGN PATENT DOCUMENTS

CN 16995594 A 11/2005
CN 100464659 C 3/2009

(Continued)

OTHER PUBLICATIONS

U.S. Appl. No. 12/326,747, filed Dec. 2, 2008 (abandoned).

(Continued)

*Primary Examiner* — Robyn Doan
*Assistant Examiner* — Brianne Kalach
(74) *Attorney, Agent, or Firm* — Dinesh Agarwal, P.C.

(57) ABSTRACT

A device for dispensing a material into a representation on a surface, includes a storage chamber for holding a material, a charging chamber operably connected to the storage chamber, and a dispensing chamber operably connected to the charging chamber, wherein the dispensing chamber is made of a non-porous substance and includes a configuration corresponding to a representation to be dispensed on a surface.

29 Claims, 3 Drawing Sheets

(56) References Cited

U.S. PATENT DOCUMENTS

| | | | |
|---|---|---|---|
| 5,913,315 | A | 6/1999 | Todd |
| 5,964,226 | A | 10/1999 | Sobel |
| 6,053,178 | A | 4/2000 | Todd |
| 6,073,635 | A | 6/2000 | Todd |
| 7,160,375 | B2 | 1/2007 | Yamamoto |
| 7,246,447 | B2 | 7/2007 | Demko |
| 7,364,614 | B2 | 4/2008 | Kwan et al. |
| 7,981,210 | B2 | 7/2011 | Kwan et al. |
| 2003/0072599 | A1 | 4/2003 | Ewart |
| 2007/0199960 | A1 | 8/2007 | Blum et al. |
| 2008/0250956 | A1 | 10/2008 | McSweeney et al. |
| 2009/0101159 | A1 | 4/2009 | Bonnafous et al. |
| 2009/0266377 | A1 | 10/2009 | Matsumoto et al. |
| 2011/0303111 | A1 | 12/2011 | Bolton |

FOREIGN PATENT DOCUMENTS

| | | | |
|---|---|---|---|
| CN | 101384188 | A | 3/2009 |
| JP | 2005-059583 | | 3/2005 |
| WO | WO 2004/019724 | | 3/2004 |
| WO | WO 2005/011991 | | 2/2005 |

OTHER PUBLICATIONS

Office Action dated Dec. 8, 2010 in U.S. Appl. No. 12/326,747, filed Dec. 2, 2008.

Search Report in Chinese/Hong Kong in App. S.N. HK 09111 (5 pp.), Apr. 24, 2009.

* cited by examiner

METHOD AND DEVICE FOR DISPENSING A MATERIAL INTO A REPRESENTATION ON A SURFACE

CROSS-REFERENCE TO RELATED APPLICATIONS

The present application claims the benefit of prior U.S. Provisional Application Ser. No. 61/627,111, filed Sep. 19, 2011, which is hereby incorporated herein in its entirety by reference.

FIELD AND BACKGROUND OF THE INVENTION

The present invention is generally directed to image transfer devices, and more particularly to a method and device for dispensing or stamping a material into a representation on a surface, such as hair, skin, fabric, leather, paper, a textured surface, etc.

There are currently a number of products that can temporarily add color and/or glitter to hair, face, etc. The products take advantage of fashion trends that are popularized by rock stars, fashion models, celebrities and other trend-setting personalities. Many of these products are powder-based, offering the user the ability to add color and/or glitter in a general facial area, or the hairstyle. Powder-based products can often be found in vials or containers that require manual application or roll-on applicators that can be used, for example, to add streaks of color/glitter to the hair. Alternatively, the powder-based products can be infused in aerosol dispensers that add a hint of color/glitter to a wide area of the hair.

Color and/or glitter can also be added by means of a gel-based product which allows for relatively more specific placement of the color and/or glitter. The color/glitter gel is typically squeezed out from the tubes or bottles and placed either directly into the hair or onto a hand for placement on the hair. The gel can then be manipulated through the hair or combed into place. These products can offer coverage to strands of hair or to an area of hair, but do not offer anything further than merely adding color/glitter into the hair style.

Various devices for dispensing fluids, gel inks, ink compositions, etc., are currently available as shown in U.S. Pat. Nos. 1,959,774; 3,148,401; 3,410,645; 3,418,055; 3,433,232; 3,726,289; 4,201,491; 5,019,033; 5,222,823; 5,421,765; 5,727,893; 5,799,669; 5,823,204; 5,848,599; 5,913,315; 5,964,226; 6,053,178; 6,073,635; 7,160,375B2; 7,246,447B2; 7,364,614B2; 7,981,210B2; 2003/0072599A1; 2007/0266377A1; 2008/0250956A1; 2009/0101159A1; 2009/0199960A1; and 2011/0303111A1; and Foreign CN 100464659C; CN 101384188A; CN 16995594A; JP2005-59583; WO 2004/019724; and WO 2005/011991.

ASPECTS AND BRIEF SUMMARY OF THE INVENTION

The present disclosure is directed to various aspects of the present invention.

One aspect of the present invention is to provide a device for dispensing a material into a representation on a surface.

Another aspect of the present invention is to provide a method for dispensing a material into a representation on a surface.

Another aspect of the present invention is to provide a device for dispensing a viscous or thick material into a representation on a surface.

Another aspect of the present invention is to provide a device for dispensing a viscous or thick material into a three-dimensional representation on a surface.

Another aspect of the present invention is to provide a device for dispensing a material into a representation on a surface. The material can include, but is not limited to, paint, gel, glitter/glue, glitter/gel, gel ink (metallic ink, glitter ink, pastel ink, etc.), or a combination thereof. The surface can be, but is not limited to, leather, skin, hair (preferably combed hair), fabric, paper, cardboard, woven material, non-woven material, or other similar textures or surfaces.

Another aspect of the present invention is to provide a device for dispensing a material into a representation of a certain thickness on a surface. The material can include, but is not limited to, paint, gel, glitter/glue, glitter/gel, gel ink (metallic ink, glitter ink, pastel ink, etc.), or a combination thereof. The surface can be, but is not limited to, leather, skin, hair (preferably combed hair), fabric, paper, or other similar textures or surfaces.

Another aspect of the present invention is to provide a device for dispensing a material into a representation on a surface, which includes a storage chamber for holding a material, a charging chamber operably connected to the storage chamber, and a dispensing chamber operably connected to the charging chamber, wherein the dispensing chamber is made of a non-porous substance and includes a configuration corresponding to a representation to be dispensed on a surface.

Another aspect of the present invention is to provide a device for dispensing a material into a representation on a surface, which includes a storage chamber for holding a material and including first and second end portions, a charging chamber positioned adjacent one of the first and second end portions of the storage chamber, and a dispensing chamber operably connected to the charging chamber and including a discharge port, wherein the dispensing chamber is made of a non-porous substance, and the discharge port includes a configuration generally corresponding to a representation to be dispensed on a surface.

Another aspect of the present invention is to provide a device for rendering a three-dimensional representation of a material on a surface, which includes a storage chamber for holding a material, a charging chamber operably connected to the storage chamber and including an opening, and a dispensing chamber operably connected to the charging chamber and including a discharge port, wherein the dispensing chamber is made of a non-porous substance, and the discharge port includes a configuration generally corresponding to a three-dimensional representation to be rendered on a surface.

Another aspect of the present invention is to provide a material dispensing kit, which includes a) a device for dispensing a material into a representation on a surface, including i) a storage chamber for holding a material, ii) a charging chamber operably connected to the storage chamber, and iii) a dispensing chamber operably connected to the charging chamber, wherein the dispensing chamber is made of a non-porous substance and includes a configuration corresponding to a representation to be dispensed on a surface, b) a quantity of the material having a viscosity value of at least 100,000 mu (μ) for use with the device.

Another aspect of the present invention is to provide a method for dispensing a material into a representation on a substrate, which includes a) providing a device, including i) a storage chamber holding a material, ii) a charging chamber operably connected to the storage chamber, iii) a dispensing chamber operably connected to the charging chamber, and iv) wherein the dispensing chamber is made of a non-porous substance and includes a configuration corresponding to a representation to be dispensed on a substrate, b) providing a substrate, c) positioning the device against the substrate, c) actuating the device so as to compress the charging chamber, and d) removing the device from the substrate.

In summary, the present invention provides a method and device for dispensing a material into a representation on a surface, and particularly a three-dimensional representation formed of a viscous material.

BRIEF DESCRIPTION OF THE DRAWINGS

One of the above and other aspects, novel features and advantages of the present invention will become apparent from the following detailed description of a preferred embodiment(s) of the invention, as illustrated in the drawings, in which.

DETAILED DESCRIPTION OF THE PREFERRED EMBODIMENT(S) OF THE INVENTION

Figure 1A:
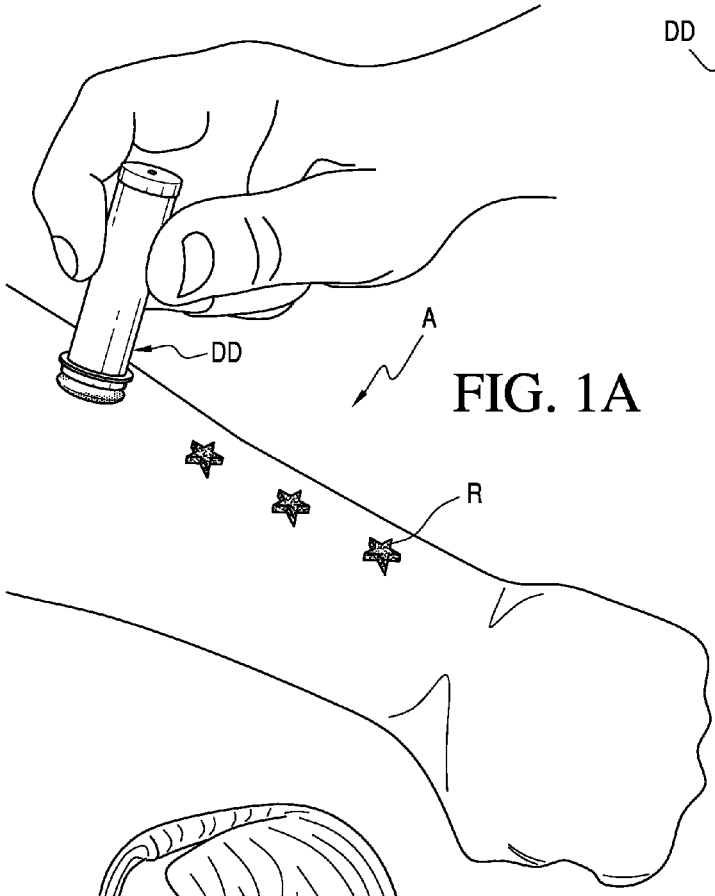
FIG. 1A is a perspective view of a preferred embodiment of the device of the present invention, shown in use on arm.
Figure 1B:
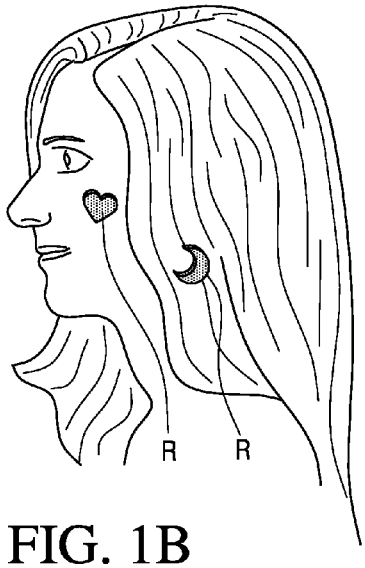
FIG. 1B is a view similar to FIG. 1A, showing representations rendered on hair and face.
Figure 2:
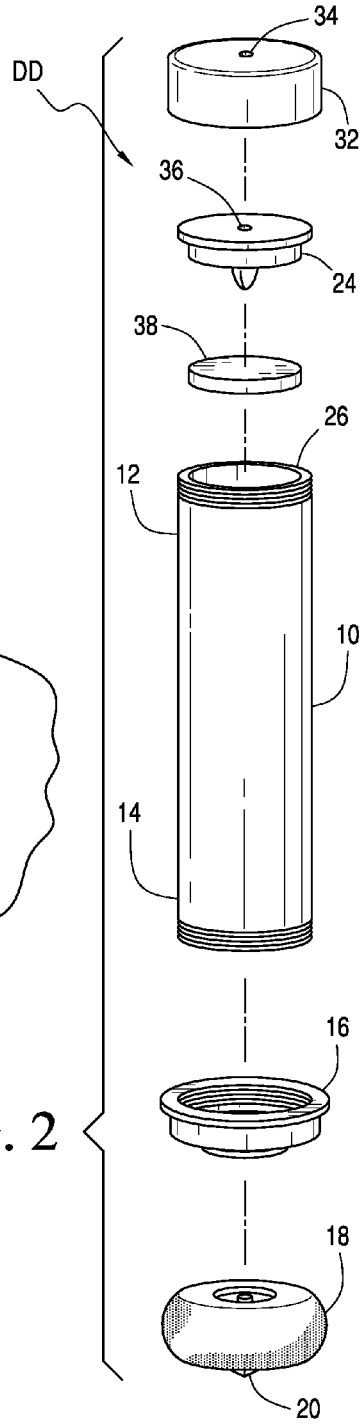
FIG. 2 is an enlarged exploded view of the device shown in FIG. 1.
Figure 3:
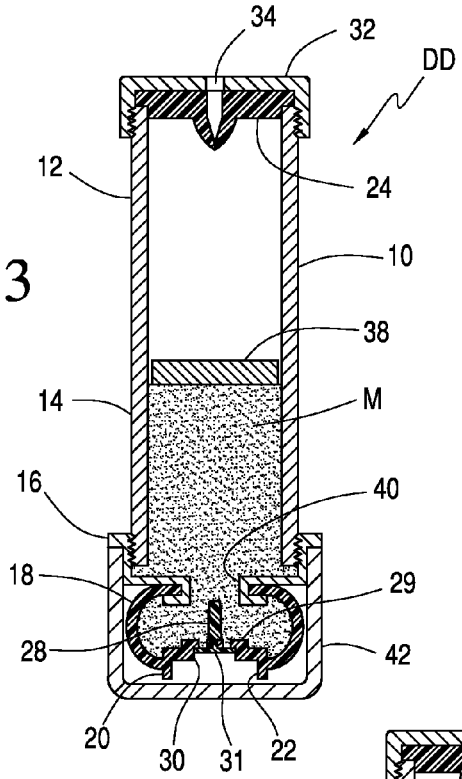
FIG. 3 is a longitudinal sectional view of the device of FIG. 2, shown with a protective bottom cap.

As best shown in FIGS. 2-3, the dispensing device DD of the present invention includes a tubular storage chamber 10 for holding a material M (discussed below in more detail) to be dispensed into a desired representation R (FIGS. 1A-B) on a surface, such as skin, hair, leather, fabric, paper, or any other texture or surface.

The storage chamber 10 includes top and bottom portions 12 and 14, respectively. A yoke member 16 is mounted on the bottom portion 14 of the storage chamber 10, and supports a charging chamber 18. The charging chamber 18 is preferably made of a flexible material, such that when a downward pressure is applied on the dispensing device DD (see arrow 'X' in FIG. 4) during its operation, the charging chamber 18 is compressed or squeezed so as to push or pump the material M therein into an adjacent or next dispensing lip or chamber 20.

Figure 6:
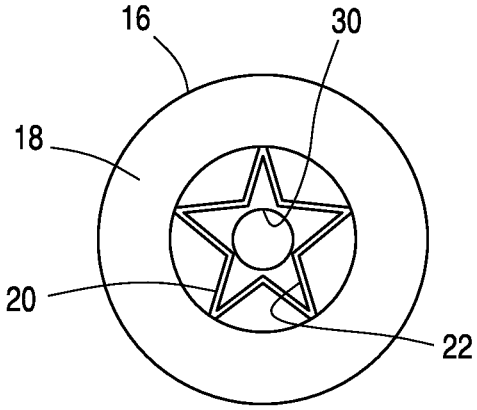
FIGS. 6-11 are bottom plan views of various alternative embodiments of the device of FIG. 2, showing shapes/designs of various representations that can be rendered on a surface.
Figure 7:
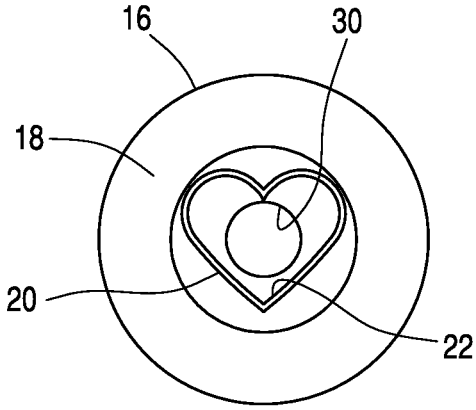
Figure 8:
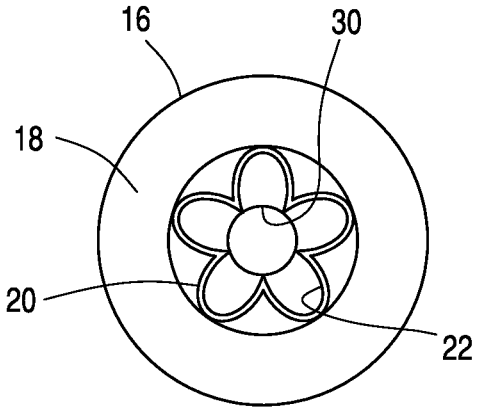
Figure 9:
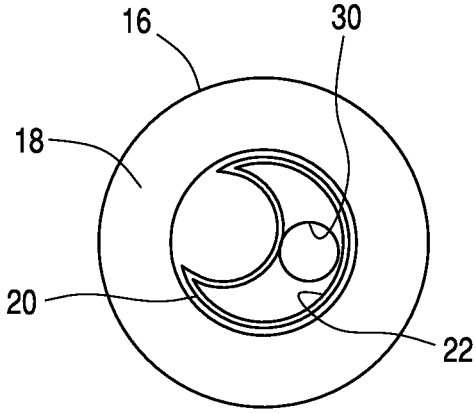
Figure 10:
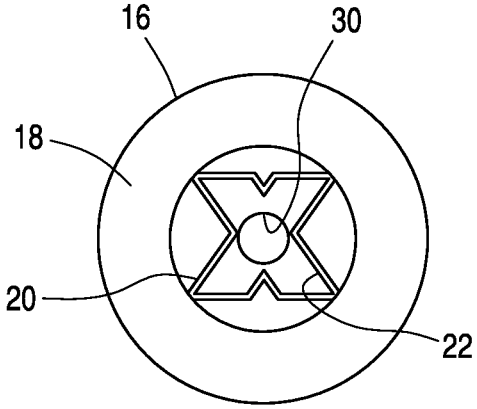

Preferably, the dispensing chamber 20 is made of a non-porous substance and includes an outline, design, or configuration corresponding to the representation R to be dispensed on the surface S. As an illustration, FIG. 6 shows the dispensing lip or chamber 20 to have a star outline or shape. Therefore, the dispensing device DD having a star-shaped dispensing chamber 20 would dispense correspondingly star-shaped designs or representations on a surface, for example arm A (FIG. 1A).

Figure 11:
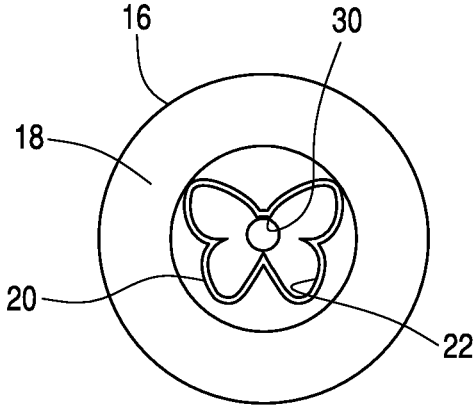

FIGS. 7-11 illustrate various other designs or representations for the dispensing chamber 20 to dispense correspondingly shaped designs, such as a heart (FIG. 7), a flower (FIG. 8), a crescent moon (FIG. 9), an 'X' (FIG. 10), and a butterfly (FIG. 11). It is noted herewith that the foregoing is merely a list of non-limiting examples, and other shapes, designs, images, indicia, outlines, patterns, facsimiles, etc., may be used for rendering corresponding shapes or designs on a surface.

The dispensing chamber 20 includes a port or opening 22 for discharging the material M therethrough. Preferably, the port or opening 22 corresponds in shape to the shape of the dispensing chamber 20.

Figure 4:
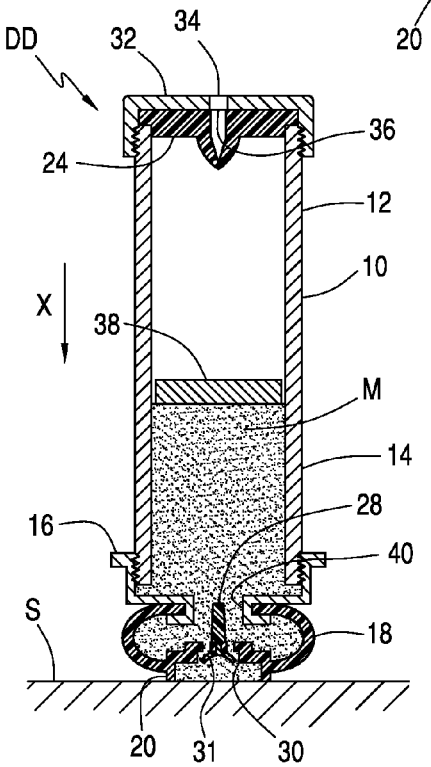
FIG. 4 is a view similar to FIG. 3, showing the device on a surface, such as paper, for dispensing a material.

A one-way valve 24 is positioned in the top opening 26 of the storage chamber 10. Likewise, a one-way metering valve 28 is held by a web-like support 29 inside the charging chamber 18, for releasing the material M through a bottom opening 30 therein (FIG. 3). More particularly, a specific amount of the material M is metered into the dispensing chamber 20, when the dispensing device DD is pressed downwardly on the surface S, thereby flexing or opening the flap portion 31 of the valve 28 (FIG. 4). The valves 24 and 28, each can be any conventional one-way valve, including, but not limited to, a flap valve, a duckbill valve, or the like.

A cover 32 is positioned over the top valve 24 and screwed onto the top portion 12 of the storage chamber 10. A hole 34 in the cover 32 is aligned with a hole 36 in the valve 24, to allow the air to pass therethrough into the storage chamber 10 when the valve 24 opens, as the dispensing device DD is removed away from the surface S during its operation (see arrow 'Y' in FIG. 5).

A disc-shaped member 38 is placed over the material M to allow a smooth and consistent downward flow in the storage chamber 10, without the air above the disc causing any interruption. In other words, the disc 38 separates the material M from the air above it from causing any adverse effect on the downward flow of the material M.

As can be seen, the material flows from the storage chamber 10 into the charging chamber 18 via an opening 40 in the yoke 16, and into the dispensing chamber 20 via the opening 30 in the charging chamber 18. Preferably, the charging and dispensing chambers 18 and 20 are made of the same material and molded as one piece.

A protective cap 42 is snap-fitted onto the yoke 16 to protect the charging and dispensing chambers 18 and 20, and to catch any material leaks.

The material M is preferably a viscous liquid, such as paint, gel, ink, or glue, including, but not limited to, metallic ink, glitter ink, and pastel ink, and the like. It is preferred that the liquid have a viscosity of at least 100,000 mu (μ) and include glitter or the like flakes and/or particles having an average size of at least 0.10 mm, and more preferably about 0.10 mm to 0.20 mm. Preferably, the particles are hexagonal in shape; however, other shapes may also be used.

Use and Operation

A preferred manner of using the dispensing device DD of the present invention will now be described.

Figure 5:
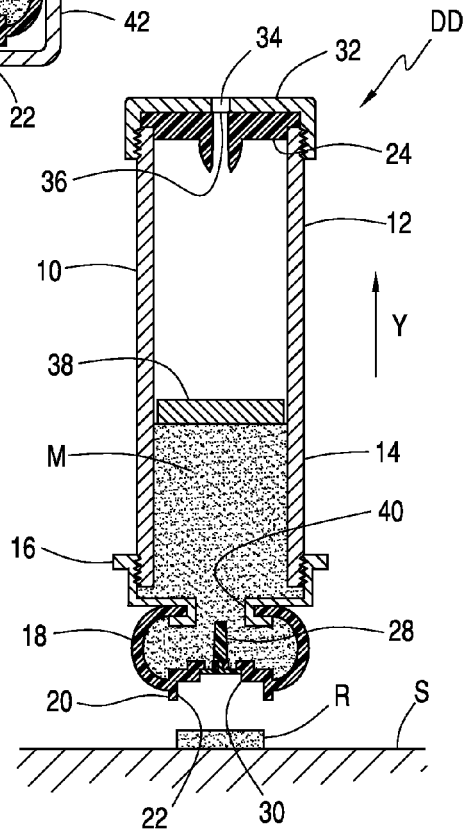
FIG. 5 is a view similar to FIG. 4, showing the device detached from the surface and having dispensed a representation on the surface.

As shown in FIG. 4, the dispensing device DD is placed against the surface S, such that the dispensing lip or chamber 20 forms a seal thereagainst. The dispensing device DD is then pushed down thereby compressing the charging chamber 18 (see arrow 'X'). In this position, the top valve 24 remains closed, while the lower metering valve 28 is open, thereby allowing (or pushing or pumping) a quantity of the material M to move into the dispensing chamber 20 from the charging chamber 18. The dispensing device DD is then gently lifted up (see arrow 'Y' in FIG. 5), leaving a representation R on the surface S. As the dispensing device DD is lifted up, the metering valve 28 closes, and the top valve 24 opens (FIG. 5).

It is noted herewith that the length of a downward push or stroke of the dispensing device DD (FIG. 4), would correspond to the extent by which the charging chamber 18 can be compressed. In other words, the length of the charging chamber 18 would generally correspond to the length of each stroke. This, in turn, would correspond to the amount of the material flowing into the dispensing chamber 20, during each stroke. Therefore, by adjusting or varying the compressibility, and therefore the length of the charging chamber 18, the amount of the material M to be metered into the dispensing chamber 20, can be controlled. Likewise, the length of the dispensing chamber 20 would correspond to the thickness of the representation R. For instance, by extending the length, and thus the depth of the dispensing chamber 20, a thicker representation would be obtained and vice versa.

Preferably, the representation R, rendered by using the dispensing device DD, has a thickness range of about 1/32 inch to about 1/8 inch, and is three-dimensional in configuration.

While this invention has been described as having preferred sequences, ranges, steps, materials, structures, shapes, configurations, features, components, or designs, it is understood that it is capable of further modifications, uses and/or adaptations of the invention following in general the principle of the invention, and including such departures from the present disclosure as those come within the known or customary practice in the art to which the invention pertains, and as may be applied to the central features hereinbefore set forth, and fall within the scope of the invention and of the limits of the appended claims.

What is claimed is:

1. A device for dispensing a viscous material into a representation on a surface, comprising:

a) a storage chamber for holding a material;

b) an externally positioned squeezable charging chamber operably connected to an end of said storage chamber;

c) a dispensing chamber operably connected to said charging chamber;

d) said charging chamber including an opening into said dispensing chamber;

e) a metering valve positioned between said charging and dispensing chambers for opening or closing said opening to thereby selectively allow the viscous material to flow into said dispensing chamber; and f) said dispensing chamber being made of a non-porous substance and having a configuration corresponding to a representation to be dispensed on a surface.

2. The device of claim 1, wherein:

a) said dispensing chamber includes a discharge port having generally the same configuration as the representation.

3. The device of claim 2, wherein:

a) the representation comprises a shape, a design, an image, an indicia, an outline, a pattern, or a facsimile.

4. The device of claim 2, wherein:

a) the representation comprises a general shape selected from the group consisting of a star, a heart, a flower, a crescent moon, a butterfly, a cross, and a combination thereof.

5. The device of claim 2, wherein:

a) said charging chamber is made of a flexible material.

6. The device of claim 5, wherein:

a) said charging chamber pushes the material into said dispensing chamber when the device is actuated.

7. The device of claim 2, wherein:

a) said storage chamber includes first and second end portions;

b) said second end portion is positioned adjacent said charging chamber; and c) an inlet valve positioned adjacent said first end portion for allowing air into said storage member.

8. The device of claim 2, further comprising:

a) a floating disc to be positioned atop the material in said storage chamber.

9. The device of claim 1, wherein:

a) said dispensing chamber includes a length generally corresponding to the thickness of the representation.

10. The device of claim 9, wherein:

a) the thickness of the representation ranges from about 1/32 inch to about 1/8 inch.

11. A device for dispensing a viscous material into a representation on a surface, comprising:

a) a storage chamber for holding a material and including first and second end portions;

b) an externally positioned squeezable charging chamber positioned adjacent one of said first and second end portions of said storage chamber;

c) a dispensing chamber operably connected to said charging chamber and including a discharge port;

d) said charging chamber including an opening into said dispensing chamber;

e) a metering valve positioned between said charging and dispensing chambers for opening or closing said opening to thereby selectively allow the viscous material to flow into said dispensing chamber;

f) said dispensing chamber being made of a non-porous substance and having a configuration corresponding to a representation to be dispensed on a surface; and g) said discharge port having the same configuration as the representation.

12. The device of claim 11, wherein:

a) the representation comprises a shape, a design, an image, an indicia, an outline, a pattern, or a facsimile.

13. The device of claim 11, wherein:

a) the representation comprises a general shape selected from the group consisting of a star, a heart, a flower, a crescent moon, a butterfly, a cross, and a combination thereof.

14. The device of claim 11, wherein:

a) said charging chamber is made of a flexible material.

15. The device of claim 14, wherein:

a) said charging chamber pushes the material into said dispensing chamber when the device is actuated.

16. The device of claim 11, further comprising:

a) an inlet valve positioned adjacent the other of said first and second end portions of said storage chamber to allow air into said storage member.

17. The device of claim 16, further comprising:

a) a floating disc to be positioned atop the material in said storage chamber.

18. The device of claim 11, wherein:

a) said dispensing chamber includes a length generally corresponding to the thickness of the representation.

19. The device of claim 18, wherein:

a) the thickness of the representation ranges from about 1/32 inch to about 1/8 inch.

20. The device of claim 11, wherein:

the representation is three dimensional in configuration and said discharge port having the same configuration as the three-dimensional representation.

21. A material dispensing kit, comprising:

a) a device for dispensing a viscous material into a representation on a surface, comprising:

i) a storage chamber for holding a material;

ii) an externally positioned squeezable charging chamber operably connected to an end of said storage chamber;

iii) a dispensing chamber operably connected to said charging chamber;

iv) said charging chamber including an opening into said dispensing chamber;

v) a metering valve positioned between said charging and dispensing chambers for opening or closing said opening to thereby selectively allow the viscous material to flow into said dispensing chamber; and vi) said dispensing chamber being made of a non-porous substance and having a configuration corresponding to a representation to be dispensed on a surface;

b) a quantity of the material for use with the device; and c) the material comprising a fluid having a viscosity value of at least 100,000 mu (μ).

22. The kit of claim 21, wherein:

a) the fluid comprises particles having an average particle size of about 0.10 mm to 0.20 mm.

23. The kit of claim 21, wherein:

a) the fluid comprises glitter particles.

24. A method for dispensing a viscous material into a representation on a substrate, comprising:

a) providing a device, comprising:

i) a storage chamber holding a material;

ii) an externally positioned squeezable charging chamber operably connected to an end of the storage chamber;

iii) a dispensing chamber operably connected to the charging chamber;

iv) the charging chamber including an opening into the dispensing chamber;

v) a metering valve positioned between the charging and dispensing chambers for opening or closing the opening to thereby selectively allow the viscous material to flow into the dispensing chamber; and vi) the dispensing chamber being made of a non-porous substance and having a configuration corresponding to a representation to be dispensed on a substrate;

b) providing a substrate;

c) positioning the device against the substrate;

d) actuating the device so as to compress the charging chamber; and e) removing the device from the substrate.

25. The method of claim 24, wherein:

the substrate comprises paper, cardboard, leather, skin, hair, fabric, a textured material, a woven material, a non-woven material, or a combination thereof.

26. The method of claim 24, wherein:

the material comprises a fluid having a viscosity value of at least 100,000 mu (μ).

27. The method of claim 24, wherein:

the fluid comprises particles having an average particle size of about 0.10 mm to 0.20 mm.

28. The method of claim 24, wherein:

the fluid comprises glitter particles.

29. The kit of claim 24, wherein:

the fluid comprises generally hexagonal particles.

* * * * *